US010183818B2

(12) United States Patent
Shinkawa et al.

(10) Patent No.: US 10,183,818 B2
(45) Date of Patent: Jan. 22, 2019

(54) SHEET LOADER, IMAGE FORMING APPARATUS INCORPORATING THE SHEET LOADER, AND IMAGE READER INCORPORATING THE SHEET LOADER

(71) Applicants: Shohei Shinkawa, Tokyo (JP); Kazuya Yamamoto, Kanagawa (JP)

(72) Inventors: Shohei Shinkawa, Tokyo (JP); Kazuya Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 121 days.

(21) Appl. No.: 14/629,694

(22) Filed: Feb. 24, 2015

(65) Prior Publication Data

US 2015/0239687 A1 Aug. 27, 2015

(30) Foreign Application Priority Data

Feb. 25, 2014 (JP) ..... 2014-033670

(51) Int. Cl.
*B65H 1/04* (2006.01)
*B65H 7/02* (2006.01)
(Continued)

(52) U.S. Cl.
CPC ..... *B65H 1/04* (2013.01); *B65H 7/02* (2013.01); *B65H 7/14* (2013.01); *B65H 7/20* (2013.01);
(Continued)

(58) Field of Classification Search
CPC . B65H 1/26; B65H 1/266; B65H 7/02; B65H 7/04; B65H 7/14; B65H 2405/10;
(Continued)

(56) References Cited

U.S. PATENT DOCUMENTS 4,920,384 A * 4/1990 Okamoto ..... G03G 15/5095 399/370
5,596,399 A * 1/1997 Dempsey ..... G03G 15/23 271/245
(Continued)

FOREIGN PATENT DOCUMENTS

JP H07097102 A 4/1995
JP H07223758 A 8/1995
(Continued)

OTHER PUBLICATIONS

Extended European Search Report dated Aug. 19, 2015.
Office Action for Corresponding Japanese Patent Application No. 2014-033670 dated Nov. 17, 2017.

*Primary Examiner* — Ernesto A Suarez
(74) *Attorney, Agent, or Firm* — Harness, Dickey & Pierce, P.L.C.

(57) ABSTRACT

A sheet loader includes a sheet loading part and a sheet length detector. The sheet loading part has a loading face on which a sheet is loaded. The sheet length detector is provided to the sheet loading part to detect a length of the sheet by obtaining information whether the loading face either contacts or approaches a surface of the sheet disposed facing the loading face at a given position on the loading face in a sheet conveying direction of the sheet loading part. The sheet length detector includes multiple projections retreatably extending outward beyond the loading face of the sheet loading part, and a projection retreating detector detecting whether the multiple projections are retreated under the loading face. At least one of the multiple projections is disposed closer to an upstream end of the sheet loading part than the other.

20 Claims, 15 Drawing Sheets

(51) Int. Cl.
*B65H 7/14* (2006.01)
*B65H 7/20* (2006.01)

(52) U.S. Cl.
CPC .... *B65H 2405/324* (2013.01); *B65H 2511/11* (2013.01); *B65H 2511/51* (2013.01); *B65H 2511/515* (2013.01); *B65H 2553/612* (2013.01); *B65H 2801/06* (2013.01)

(58) Field of Classification Search
CPC ..... B65H 2405/11; B65H 2405/112; B65H 2405/1122; B65H 2405/32; B65H 2405/324; B65H 2511/10; B65H 2511/11; B65H 2553/31; B65H 2553/60; B65H 2553/61; B65H 2553/62; B65H 2553/612; B65H 2553/80; B65H 2553/82; B65H 2553/822; G03G 15/607; G03G 15/6514; G03G 2215/00329
USPC ..... 399/370
See application file for complete search history.

(56) References Cited

U.S. PATENT DOCUMENTS 5,743,522 A * 4/1998 Rubscha ..... B65H 1/04 221/6
5,946,527 A * 8/1999 Salgado ..... B65H 1/04 271/3.01
7,059,597 B2 * 6/2006 Shirakura ..... B65H 1/04 271/145
7,460,825 B2 * 12/2008 Sawanaka ..... G03G 15/607 271/111
7,557,968 B2 * 7/2009 Onodera ..... B65H 5/34 271/264
7,832,726 B2 * 11/2010 Osakabe ..... B65H 7/02 271/171
8,430,398 B2 * 4/2013 Kamichi ..... B65H 1/04 271/171
2009/0244649 A1 10/2009 Shinkawa
2013/0299681 A1 11/2013 Tsai et al.
2014/0376014 A1 12/2014 Hatayama et al.

FOREIGN PATENT DOCUMENTS

JP H11295824 A 10/1999
JP 2002347986 A 12/2002
JP 2008265976 A 11/2008
JP 2009249087 A 10/2009
JP 2009-260912 11/2009
JP 2011-225293 11/2011

* cited by examiner

SHEET LOADER, IMAGE FORMING APPARATUS INCORPORATING THE SHEET LOADER, AND IMAGE READER INCORPORATING THE SHEET LOADER

CROSS-REFERENCE TO RELATED APPLICATIONS

This patent application is based on and claims priority pursuant to 35 U.S.C. § 119(a) to Japanese Patent Application No. 2014-033670, filed on Feb. 25, 2014, in the Japan Patent Office, the entire disclosure of which is hereby incorporated by reference herein.

BACKGROUND

Technical Field

This disclosure relates to a sheet loader that can be provided to a copier, a printer, a facsimile machine and so forth, an image forming apparatus that includes the sheet loader, and an image reader that includes the sheet loader.

Related Art

As an example of a sheet loader, a sheet set on a bypass tray that is a sheet loading table is conveyed from the sheet loading table to an image forming part via a sheet conveying device.

The sheet loader includes a sheet length detector to detect the length of a sheet. The sheet length detector is disposed on the sheet loading table that faces the sheet when a sheet having a length of half or greater than a maximum size in a sheet conveying direction is set on the sheet loading table and that does not face the sheet when a sheet having a length less than the maximum size in the sheet conveying direction is set on the sheet loading table.

The sheet length detector includes a sheet detecting part and a retraction detecting part. The sheet detecting part projects on a loading face of the sheet loading table to be movable forward and backward. The retraction detecting part includes a transmission optical sensor that detects whether the sheet detecting part has retracted under the loading face.

The sheet length detector detects a sheet having a length greater than a specific length by a series of operations. Specifically, when a sheet is set on the loading face, the sheet detecting part that is projected from the loading face of the bypass tray is pressed by the sheet and is hidden and stored inside the bypass tray, and thereby the transmission optical sensor is blocked or transmitted. As a result, the sheet length detector detects a sheet greater in size than a given sheet having a specific length.

In this example of the sheet loader, by using detection results obtained by the sheet length detector, the size of the sheet loaded on the sheet loading table can be narrowed to previously given standard sizes.

Specially, the bypass sheet feeder includes a lateral size sensor to detect the length of the sheet in a width direction depending on respective positions of side fences contacting both lateral ends of the sheet set on the sheet loading table.

By combining detection results obtained by the lateral size sensor and detection results obtained by the sheet length detector, the size of the sheet set on the sheet loading table can be specified to one of the previously given standard sizes.

SUMMARY

At least one aspect of this disclosure provides a sheet loader including a sheet loading part and a sheet length detector. The sheet loading part has a loading face on which a sheet is loaded. The sheet length detector is provided to the sheet loading part to detect a length of the sheet by obtaining information whether the loading face either contacts or approaches a surface of the sheet disposed facing the loading face at a given position on the loading face in a sheet conveying direction of the sheet loading part. The sheet length detector includes multiple projections and a projection retreating detector. Each of the multiple projections retreatably extends outward beyond the loading face of the sheet loading part. The projection retreating detection detects whether the multiple projections are retreated under the loading face. At least one of the multiple projections is disposed at a position closer to an upstream end of the sheet loading part in the sheet conveying direction than the other of the multiple projections.

Further, at least one aspect of this disclosure provides an image forming apparatus including the above-identified sheet loader and an image forming part to form and transfer an image onto the sheet fed from the sheet loader.

Further, at least one aspect of this disclosure provides an image reader including the above-identified sheet loader and an image reading member to receive and read an image formed on the sheet loaded on the sheet loader.

DETAILED DESCRIPTION

Figure 1:
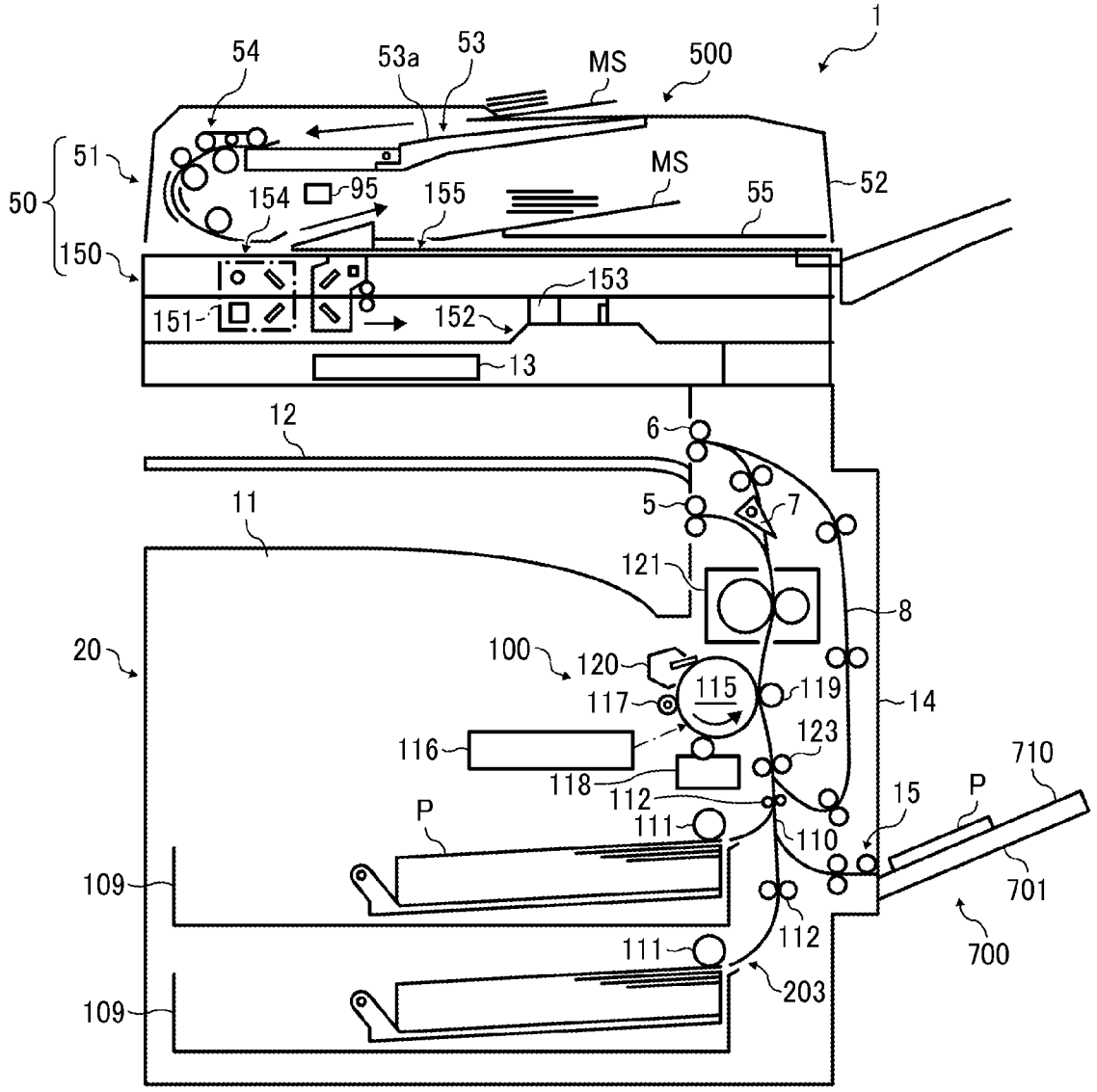
FIG. 1 is a schematic diagram illustrating an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 1 according to an example of this disclosure, with reference to FIGS. 1 through 16.

FIG. 1 is a schematic diagram illustrating the image forming apparatus 1 according to this example.

The image forming apparatus 1 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

As illustrated in FIG. 1, the image forming apparatus 1 includes an apparatus body 20 to include an image forming part 100, a sheet feeding part 203, and a control panel 13.

The image forming part 100 is disposed at a substantially center of the apparatus body 20.

The sheet feeding part 203 is disposed below the image forming part 100.

The control panel 13 is a device with which an operator inputs instructions to the image forming apparatus 1 for image forming.

The image forming apparatus 1 further includes an image reading unit 50 that includes a scanner 150 and an automatic document feeder 51 (hereinafter, referred to as an ADF 51). The image reading unit 50 functions as an image reader. The scanner 150 is mounted on the image forming part 100. The ADF 51 is disposed above the scanner 150 and supported by the scanner 150.

It is to be noted that, in the image forming apparatus 1 according to this example, the ADF 51 is included in a sheet loader 500.

The sheet feeding part 203 includes two sheet trays 109. The sheet trays 109 are detachably attached to the apparatus body 20 and accommodate different types of sheets P from each other.

The sheet P is fed by a sheet feed roller 111 from a selected one of the sheet trays 109 to a sheet conveying path 110 that extends from the sheet feeding part 203 to the sheet output part 11 in a substantially vertical direction. The sheet P is further conveyed in the sheet conveying path 110 by a selected one of sheet conveying roller pairs 112. After an image is formed in the image forming part 100 and is fixed to the sheet P, the sheet P is output to the sheet output part 11 by a sheet output roller pair 5.

The image forming part 100 includes a photoconductor 115 and an optical writing device 116.

The photoconductor 115 functions as an image bearer to rotate counterclockwise as indicated by arrow in FIG. 1.

The optical writing device 116 forms an electrostatic latent image on a surface of the photoconductor 115.

Image forming components are disposed around the photoconductor 115. These image forming components are a charging device 117, a developing device 118, a transfer roller 119, and a cleaning device 120 and are disposed counterclockwise in this order around the photoconductor 115.

The charging device 117 functions as a charger to uniformly charge the surface of the photoconductor 115.

The developing device 118 develops the electrostatic latent image formed on the surface of the photoconductor 115 by supplying toner thereon into a visible toner image. The transfer roller 119 transfers the toner image formed by the developing device 118 onto the sheet P.

The image forming apparatus 1 further includes a cleaning device 120 and a fixing device 121. The cleaning device 120 cleans the photoconductor 115 by removing residual toner remaining on the surface of the photoconductor 115 after the toner image has been transferred onto the sheet P.

The fixing device 121 is disposed between the transfer roller 119 and the sheet output part 11. The fixing device 121 fixes the toner image to the sheet P by application of heat and pressure.

The optical writing device 116 emits laser light to irradiate the surface of the photoconductor 115 based on image data of an original document read by the scanner 150 or image data inputted via a personal computer (PC). By optically writing the image data by the optical writing device 116, an electrostatic latent image is formed on the surface of the photoconductor 115.

The sheet P is fed by one of the sheet feed rollers 111 selectively from one of the sheet trays 109 and is conveyed in a sheet conveying path 110.

Further, the sheet P is stopped at a registration roller pair 123 that is disposed upstream from the transfer roller 119 in a sheet conveying direction, which is denoted as "CD" in the drawing sheets. When the registration roller pair 123 starts again, the sheet P is conveyed to a nip area formed between the transfer roller 119 and the photoconductor 115. At this time, the toner image is transferred from the photoconductor 115 onto the sheet P.

The sheet P having the toner image transferred thereto in the nip area is conveyed to the fixing device 121, where the toner image on the sheet P is fixed to the sheet P by application of heat and pressure. After this fixing operation, the sheet P is conveyed to the sheet output part 11 by the sheet output roller pair 5 to be output to the outside of the apparatus body 20 of the image forming apparatus 1.

The image forming apparatus 1 according to this example can perform duplex printing. When printing both sides of the sheet P, after the toner image is fixed to the surface of the sheet P, a bifurcating claw 7 switches the sheet conveying path to convey the sheet P toward the reverse roller pair 6.

After outputting the sheet P to a midway part of a sheet reversing tray 12, the reverse roller pair 6 reverses to convey the sheet P toward a duplex sheet conveying path 8. When conveyed to the duplex sheet conveying path 8, the sheet P is reversed and conveyed to the registration roller pair 123 again.

After being transferred from the photoconductor 115 to the back of the sheet P that is conveyed from the registration roller pair 123 to the nip area, the toner image is fixed to the sheet P in the fixing device 121 and is output to the sheet output part 11 by the sheet output roller pair 5.

The image reading unit 50 that includes the scanner 150 mounted on the image forming part 100 and the ADF 51 disposed above the scanner 150 further includes two fixed reading parts and a movable reading part 152.

The movable reading part 152 is disposed immediately below a second exposure glass 155 to move optical components such as a light source and reflection mirrors in left and right directions (in a horizontal direction) in FIG. 1. The second exposure glass 155 is mounted on an upper wall of a casing of the scanner 150 so as to contact an original document MS.

In the course of moving the optical components from left to right in FIG. 1, the light source emits light. After a surface of the original document MS placed on the second exposure glass 155 reflects the light, the reflected light is further reflected on multiple reflection mirrors until an image reading sensor 153 that is attached to the scanner 150 receives the reflected light.

The image reading unit 50 further includes a first fixed reading part 151 and a second fixed reading part 95. The first fixed reading part 151 is disposed in the scanner 150. The second fixed reading part 95 is disposed in the ADF 51.

The first fixed reading part 151 includes a light source, reflection mirrors, and image reading sensors such as charge coupled device (CCD) sensor and is disposed immediately below a first exposure glass 154 that is mounted on the upper wall of the casing of the scanner 150 so as to contact the original document MS.

When the original document MS that is conveyed by the ADF 51 passes over the first exposure glass 154, the light source emits light. After a surface of the original document MS sequentially reflects the light, the reflected light is further reflected on multiple reflection mirrors until the image reading sensor 153 receives the reflected light.

With the above-described actions, the first face of the original document MS is scanned without moving the optical components such as the light source and the reflection mirrors.

The second fixed reading part 95 scans a second face of the original document MS after the original document MS passes the first fixed reading part 151.

The ADF 51 disposed on the scanner 150 includes a cover 52, an original document loading table 53, an original document conveying part 54, and an original document stacking table 55. The original document loading table 53 is a part on which the original document MS is loaded before being scanned. The original document loading table 53 functions as a sheet loading part and has a loading face 53*a*. The original document conveying part 54 is a part to convey the original document MS as a sheet material. The original document stacking table 55 is a part on which the original document MS is stacked after being scanned.

The image forming apparatus 1 further includes a cover 14. The cover 14 is disposed to open and close relative to the apparatus body 20. Specifically, in case of a paper jam in the duplex sheet conveying path 8, the cover 14 is opened to expose an inside of the duplex sheet conveying path 8. As illustrated in FIG. 1, the cover 14 includes a bypass sheet feeder 15 and a bypass tray 701 to feed more various types of sheets P.

The bypass tray 701 can open and close with respect to the cover 14. FIG. 1 depicts the cover 14 with the bypass tray 701 open. While the bypass tray 701 is open, the sheet P is loaded thereon to be fed by the bypass sheet feeder 15 toward the inside of the image forming apparatus 1.

It is to be noted that, in the image forming apparatus 1 according to this example, the bypass tray 701 is included in a sheet loader 700.

A description is given of the bypass tray 701 according to an example of this disclosure, with reference to FIGS. 2 through 9.

Figure 2:
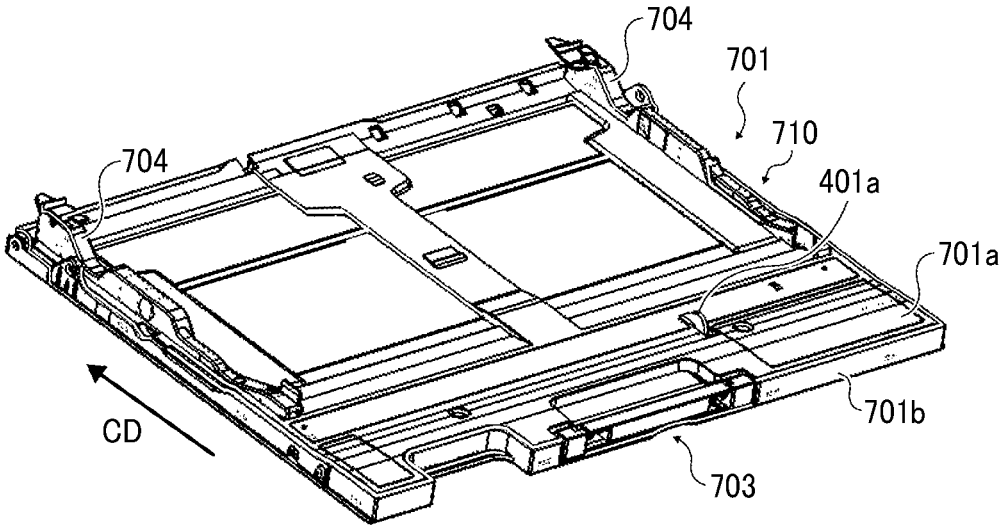
FIG. 2 is a diagram illustrating a bypass tray according to an example of this disclosure.

FIG. 2 is a diagram illustrating the bypass tray 701 according to this example.

The bypass tray 701 includes a sheet loader cover 701*a* and a bypass tray body 701*b*. In view of space saving and better operability, the bypass tray body 701*b* has a length in the sheet conveying direction substantially equal to the length of a sheet P of A4 size or B5 size, which are frequently used. The bypass tray body 701*b* contains an extendable tray 703 therein. The extendable tray 703 functions as an extendable loading part and is extended from the bypass tray body 701*b*.

Figure 3:
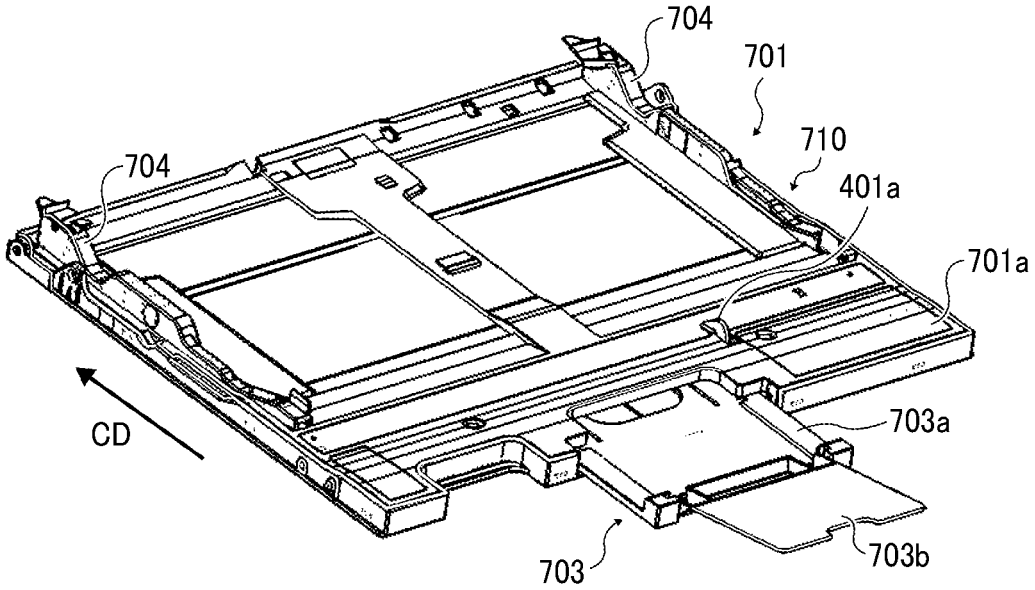
FIG. 3 is a diagram illustrating a state in which an extendable tray is pulled out from the bypass tray.

FIG. 3 is a diagram illustrating a state in which the extendable tray 703 is pulled out from the bypass tray 701.

The bypass tray 703 includes an extendable tray body 703*a* and an auxiliary tray 703*b*. The extendable tray body 703*a* is slidably supported with respect to the bypass tray body 701*b*. The auxiliary tray 703*b* is foldably attached to the extendable tray body 703*a*.

When a large-sized sheet P such as an A3 size sheet and a B4 size sheet is fed to the image forming apparatus 1 via the bypass tray 701, an operator pulls out the extendable tray body 703*a* of the extendable tray 703 from the bypass tray body 701*b*, as illustrated in FIG. 3. Along with this pulling out of the extendable tray body 703*a*, the auxiliary tray 703*b* is unfolded from the extendable tray body 703*a*. According to the above-described operation, a part of the sheet P exceeding beyond the bypass tray body 701*b* is received and supported by the extendable tray 703.

Further, any of various types of sheets P is loaded on the bypass tray 701. Therefore, before starting the printing operation, the image forming apparatus 1 recognizes the size of the sheet P loaded on the bypass tray 701.

A pair of side fences 704 is provided on the bypass tray body 701*b* to slide on the bypass tray body 701*b* in a sheet width direction, which is denoted as "WD" in the drawing sheets. The pair of side fences 704 slides on the bypass tray 701 to align the sheet P in the sheet width direction.

The bypass tray 701 includes a variable resister and a rotary switch 705 to move in conjunction with the pair of side fences 704. With these units, a length of the sheet P in the sheet width direction when the sheet P is placed on the bypass tray 701.

Figure 4:
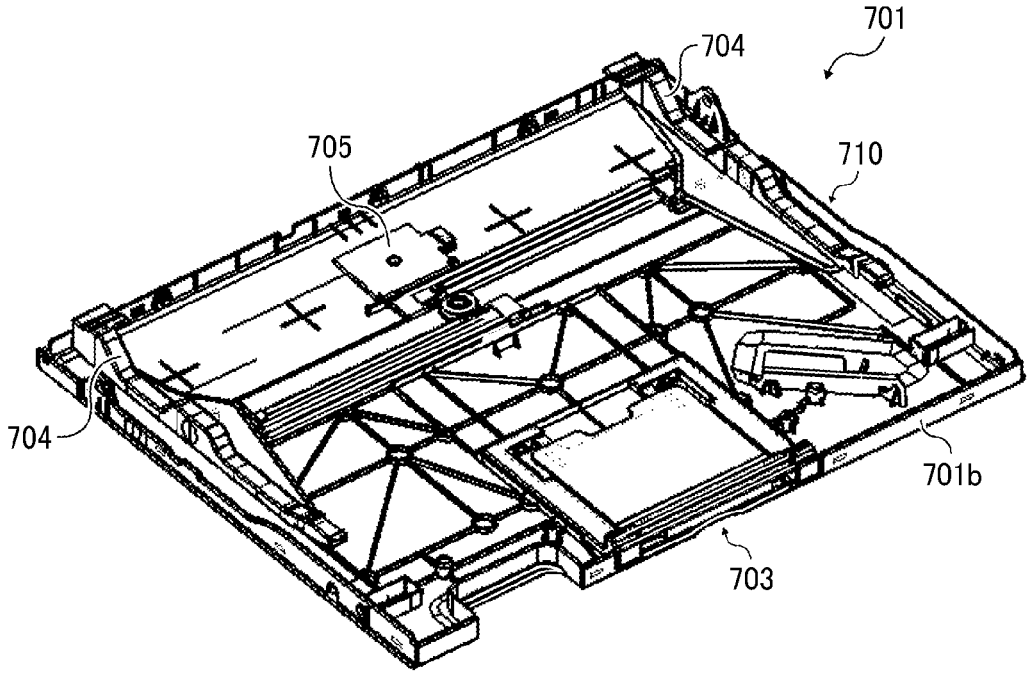
FIG. 4 is a diagram illustrating a rotary switch provided to the bypass tray of FIG. 2.

FIG. 4 is a diagram illustrating the bypass tray 701 of FIG. 2 with the rotary switch 705 thereon.

Figure 5:
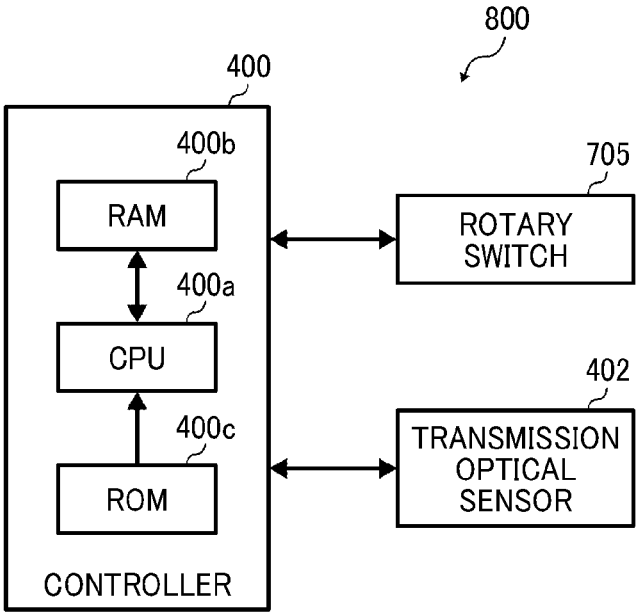
FIG. 5 is a diagram illustrating a controller provided to the image forming apparatus according to an example of this disclosure.

FIG. 5 is a diagram illustrating a controller 400 provided to the image forming apparatus 1 according to an example of this disclosure. The controller 400 as illustrated in FIG. 5 includes a central processing unit (CPU) 400*a*, a random access memory (RAM) 400*b*, and a read-only memory (ROM) 400*c*, and is connected to the rotary switch 705, a transmission optical sensor 402 described below, and so forth. In this example, the controller 400 is included in the image forming apparatus 1.

It is to be noted that the controller 400, the rotary switch 705, and the transmission optical sensor 402 form a sheet size discriminator 800. The sheet size discriminator 800 discriminates whether the sheet P loaded on the loading face 710 of the bypass tray 701 has a size of given multiple types of sheets based on detection results obtained by a sheet length detector 401 and detection results of the rotary switch 705.

However, there is a case in which the sheet size cannot be specified with the width of the sheet P placed on the bypass tray 701. For example, since a lateral side of an A4-size sheet P is same as a longitudinal side of an A3-size sheet P, the sheet size cannot be specified.

Therefore, the sheet length detector 401 that is provided to the bypass tray body 701*b* detects whether or not the sheet P placed on the bypass tray 701 has a given length or greater in the sheet conveying direction. Based on these detection results of the width and length of the sheet P in the sheet conveying direction, the sheet size is specified.

Figure 6:
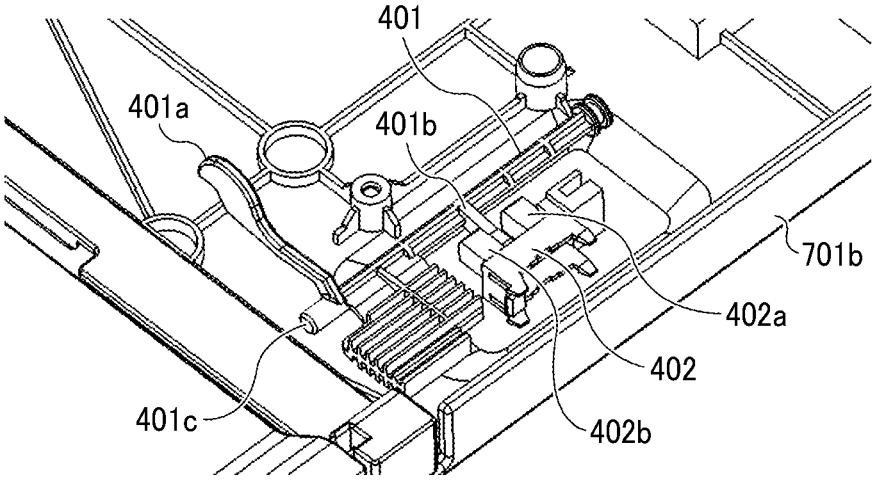
FIG. 6 is a diagram illustrating a sheet length detector.

FIG. 6 is a diagram illustrating the sheet length detector 401.

It is to be noted that the sheet loader cover 701*a* illustrated in FIG. 2 is not depicted in FIG. 6. The sheet loader cover 701*a* is a component of the bypass tray body 701*b*.

The sheet length detector 401 includes a sheet detecting part 401*a*, a light blocking part 401*b*, and a rotary shaft 401*c*. The rotary shaft 401*c* is rotatably supported by the bypass tray 701. The sheet detecting part 401*a* is disposed at one end in an axial direction of the rotary shaft 401*c*. The light blocking part 401*b* is disposed at a center or a substantially center in the axial direction of the rotary shaft 401*c*.

The sheet length detector 401 further includes the transmission optical sensor 402. The transmission optical sensor 402 functions as a projection retreating detector and includes a light emitting part 402*a* and a light receiving part 402*b* disposed with the light blocking part 401*b* sandwiched therebetween.

The sheet detecting part 401*a* is disposed to project upward from a loading face 710 of the bypass tray body 701*b*. When the length in the sheet conveying direction of the sheet P loaded on the bypass tray 701 reaches the sheet detecting part 401*a* of the sheet length detector 401, the sheet detecting part 401*a* is pressed by the sheet P toward the inside of the bypass tray 701.

Pressing the sheet detecting part 401*a* under the bypass tray 701 rotates the rotary shaft 401*c*. Along with the rotation of the rotary shaft 401*c*, the light blocking part 401*b* rotates to block or transmit light from the light receiving part 402*b* of the transmission optical sensor 402. According to the above-described actions, the sheet P that is loaded on the bypass tray 701 is detected to be the given length or greater.

It is to be noted that a transmission optical sensor (e.g., the transmission optical sensor 402) can be replaced with a reflective optical sensor. For example, the reflective optical sensor can be applied to this disclosure to detect whether or not the length of the sheet P placed on the bypass tray 701 is a given length or greater based on presence or absence of the reflected light due to actions of the light blocking part 401*b*.

Figure 7:
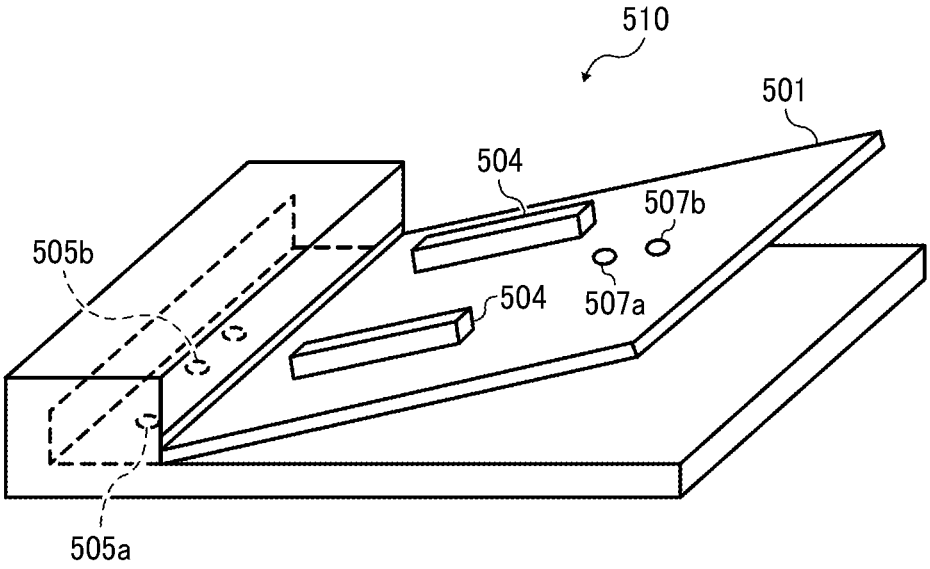
FIG. 7 is a perspective view illustrating an example of a known automatic document feeder (ADF) employing reflective optical sensors.

FIG. 7 is a perspective view illustrating an example of an ADF 510 employing reflective optical sensors. The ADF 510 is a known automatic document feeder including a document tray 501, a pair of side fences 504, document width sensors 505*a* and 505*b*, and document length sensors 507*a* and 507*b*. An original document such as the original document MS is placed on the document tray 501. The pair of side fences 504, which correspond to the pair of side fences 704 of the bypass tray 701, slide on the document tray 501 in a document width direction to align the sheet placed thereon in the document width direction. The document width sensors 505*a* and 505*b* are sheet width detectors to detect the width of the original document. The document length sensors 507*a* and 507*b* are sheet length detectors to detect the length of the original document.

In a bypass sheet feeder according to a comparative example, a sheet length detector detects the presence or absence of existence of a sheet in the vicinity of an upstream end of a sheet loading table in the sheet conveying direction.

Therefore, when a sheet having a length long enough to be detected by the sheet length detector is set on the sheet loading table, the trailing end of the sheet extends beyond the upstream end of the sheet loading table in the sheet conveying direction as if the trailing end of the sheet is hanging from the upstream end of the sheet loading table.

Therefore, most of conventional image forming apparatuses includes an extendable loading part that is disposed at an edge of the upstream end of the sheet loading part such as the sheet loading table in the sheet conveying direction. The extendable loading part extends from an edge of the upstream end of the sheet loading table in the sheet conveying direction to load the trailing end of the sheet that extends outside toward the upstream end of the sheet loading table in the sheet conveying direction.

This extendable loading part is switchable between an extended state in which the trailing end of the sheet extended outside the loading face is loaded and a non-extended state in which the trailing end of the sheet extended outside the loading face is not loaded. Therefore, when a sheet having the trailing end that does not extend outside the loading face is set on the sheet loading part, the extendable loading part is in the non-extended state. By contrast, when a sheet having the trailing end that extends outside the loading face is set on the sheet loading part, the extendable loading part is in the extended state.

Therefore, when a sheet having a long trailing end that extends to an outside of the loading face is set on the sheet loading part, an extendable loading part is extended so that the trailing end of the sheet does not hang from the sheet loading part. Accordingly, the above-described inconvenience does not occur.

Figure 8:
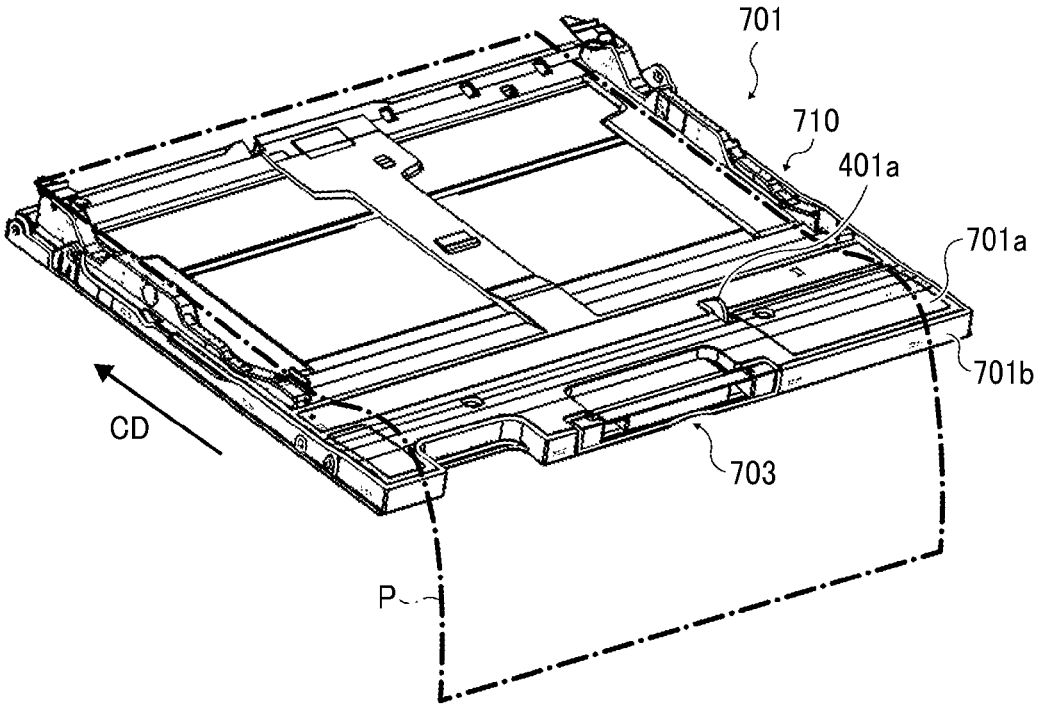
FIG. 8 is a perspective view illustrating the bypass tray when a large-size sheet is set without extending the extendable tray to a tray body of the bypass tray.
Figure 9:
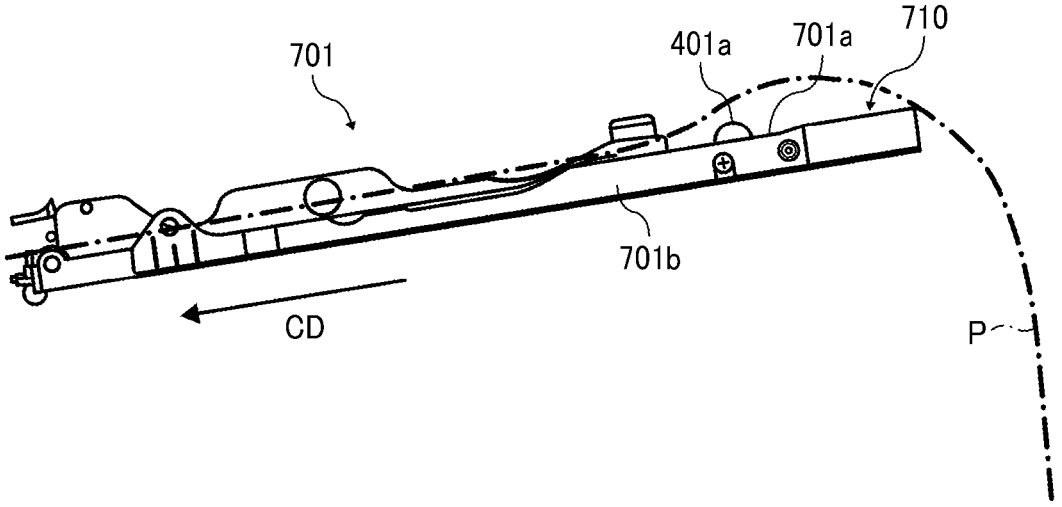
FIG. 9 is a side view illustrating the bypass tray when the large-size sheet is set without extending the extendable tray to the tray body of the bypass tray.

FIG. 8 is a perspective view illustrating the bypass tray 701 when a large-size sheet P is set on the bypass tray 701 without extending the extendable tray 703 to the bypass tray body 701*b*. FIG. 9 is a side view illustrating the bypass tray 701 when a large-size sheet P is set on the bypass tray 701 without extending the extendable tray 703 to the bypass tray body 701*b*.

When the large-size sheet P is set on the bypass tray 701 without extending the extendable tray 703 to the bypass tray body 701*b*, an upstream side of the sheet P in the sheet conveying direction exceeds beyond and hangs from the bypass tray body 701*b*, as illustrated in FIGS. 8 and 9.

Accordingly, part of the sheet P goes upward off from the bypass tray body 701*b*. When the sheet P is located at a position higher than a detectable height of the sheet detecting part 401*a* that is disposed on the bypass tray body 701*b*, the length in the sheet conveying direction of the sheet P cannot be detected correctly. Accordingly, for example, the sheet length detector 401 detects the longitudinal side of an A3-size sheet P to be the lateral side of an A4-size sheet P. As a result, sheet feeding cannot be performed correctly.

This inconvenience can be removed by increasing an amount of projection of the sheet detecting part 401*a* to increase a detectable height, by adding another sheet length detector 401 in an area having a smaller rise of the sheet P, or by performing both.

However, along with a reduction in size of recent image forming apparatuses (e.g., the image forming apparatus 1), a bypass tray (e.g., the bypass tray 701) becomes thinner in thickness. Therefore, the detectable height of the sheet detecting part 401*a* of the sheet length detector 401 is limited depending on a thickness of a bypass tray body (e.g., the bypass tray body 701*b*) which functions as a sheet containing part of the sheet detecting part 401*a*. Accordingly, it is difficult to increase the detectable height of the sheet detecting part 401*a* by increasing the amount of projection of the sheet detecting part 401*a*. In order to avoid an increase in cost, it is also difficult to employ multiple transmission sensors for detection of the length of a sheet.

A description is given of a configuration of the bypass tray 701 according to another example of this disclosure, with reference to FIGS. 10 through 16.

Figure 10:
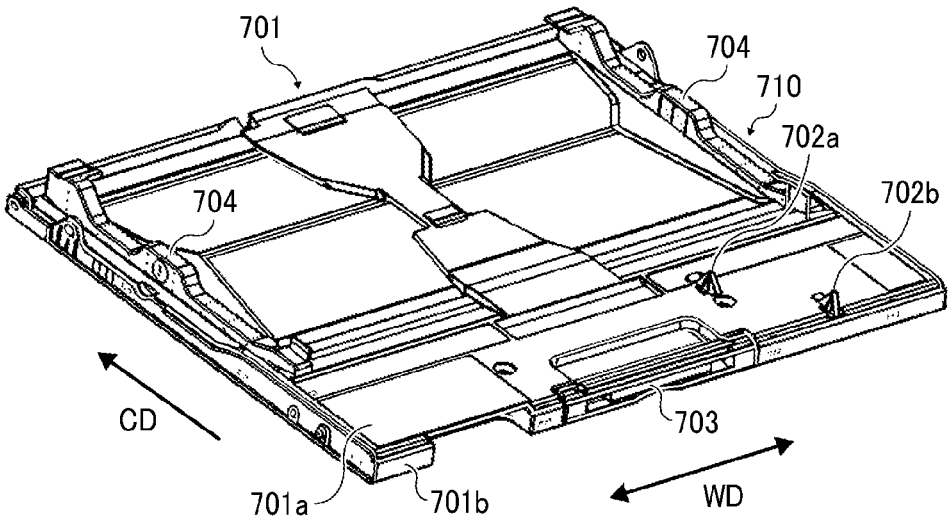
FIG. 10 is a perspective view illustrating a bypass tray provided to the image forming apparatus according to an example of this disclosure.

FIG. 10 is a perspective view illustrating the bypass tray 701 provided to the image forming apparatus 1 according to an example of this disclosure.

It is to be noted that a basic configuration of the bypass tray 701 is substantially identical to the bypass tray 701 illustrated in FIGS. 2 through 9, and therefore a detailed description of the configuration of the bypass tray 701 illustrated in FIG. 10 is omitted.

The bypass tray 701 according to this example includes the bypass tray body 701*b* and the sheet loader cover 701*a*. The sheet loader cover 701*a* covers a sensor part of the sheet length detector 702 that is disposed inside the bypass tray body 701*b*.

The sheet length detector 702 includes a first sheet detecting part 702*a* and a second sheet detecting part 702*b*. Both the first sheet detecting part 702*a* and the second sheet detecting part 702*b* function as a projection that project to be movable forward and backward from the loading face 710 of the bypass tray body 701*b* and the sheet loader cover 701*a* on which the sheet P is loaded.

The first sheet detecting part 702*a* to the bypass tray 701 is located at the same position as the sheet detecting part 401*a* to the bypass tray 701 in FIG. 2.

By contrast, the second sheet detecting part 702*b* is disposed upstream from the first sheet detecting part 702*a* in the sheet conveying direction of the bypass tray 701 and closer to one lateral end of the bypass tray 701 in the sheet width direction, which is a direction perpendicular to the sheet conveying direction. In addition, the second sheet detecting part 702*b* in this example is disposed in the vicinity of or close to an upstream end of the bypass tray 701 in the sheet conveying direction.

Figure 11:
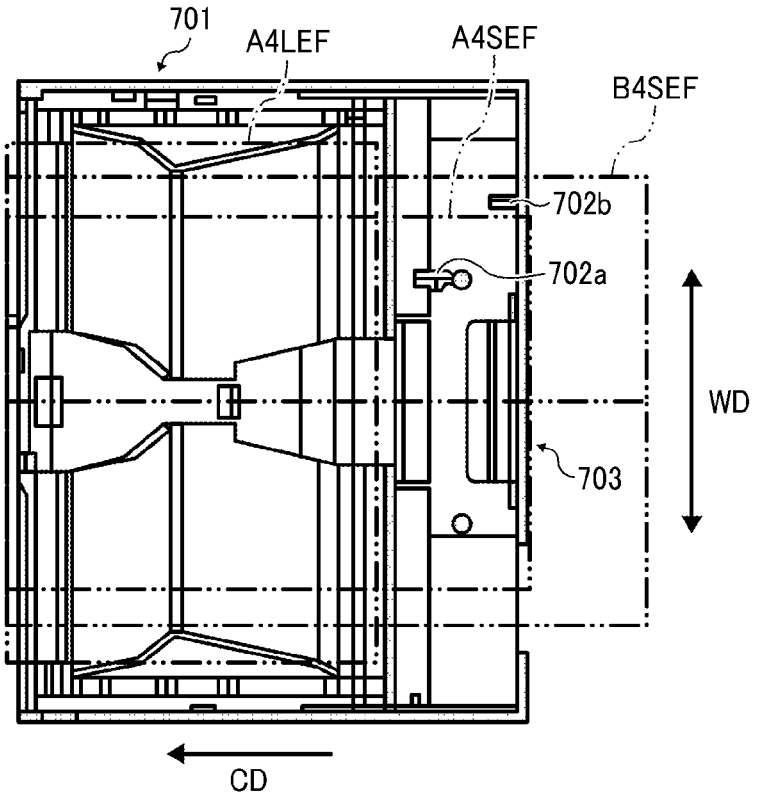
FIG. 11 is a diagram illustrating positions of a first sheet detecting part and a second sheet detecting part of the sheet length detector.

FIG. 11 is a diagram illustrating positions of the first sheet detecting part 702*a* and the second sheet detecting part 702*b* of the sheet length detector 702.

How to discriminate an A5LEF sheet from an A4SEF sheet and an A4LEF sheet from an A3SEF is described with the sheet length detector 702.

It is to be noted that "SEF" indicates a short edge feed in feeding a sheet having a short edge in the sheet conveying direction and "LEF" indicates a long edge feed in feeding a sheet having a long edge in the sheet conveying direction.

The first sheet detecting part 702*a* in the sheet conveying direction of the bypass tray body 701*b* is located at a position where the sheet P is not detected when the A5LEF sheet or the A4LEF sheet is conveyed and the sheet P is detected when the A4SEF sheet is conveyed. Therefore, the first sheet detecting part 702*a* is disposed at a position outside and away from a region of the upstream side of the A4LEF sheet in the sheet conveying direction when the sheet P is loaded on the bypass tray body 701*b*.

Further, the first sheet detecting part 702*a* in the sheet width direction of the bypass tray body 701*b* is located at a position where the sheet P is detected when the A4SEF sheet is conveyed. Therefore, the first sheet detecting part 702*a* is disposed at a position inside of a region of the A4SEF sheet in the sheet width direction when the sheet P is loaded on the bypass tray body 701*b*.

By contrast, the second sheet detecting part 702*b* in the sheet conveying direction of the bypass tray body 701*b* is located at the upstream end of the bypass tray body 701*b* in the sheet conveying direction, as described above.

The second sheet detecting part 702*b* in the sheet width direction of the bypass tray body 701*b* is preferably disposed at a position inside a width of the sheet P as much as possible. In this example, the second sheet detecting part 702*b* is disposed outside from the bypass tray body 701*b* at the upstream side in the sheet conveying direction and inside the width of a B4SEF sheet that is a given size greater than the A4SEF sheet.

Figure 12:
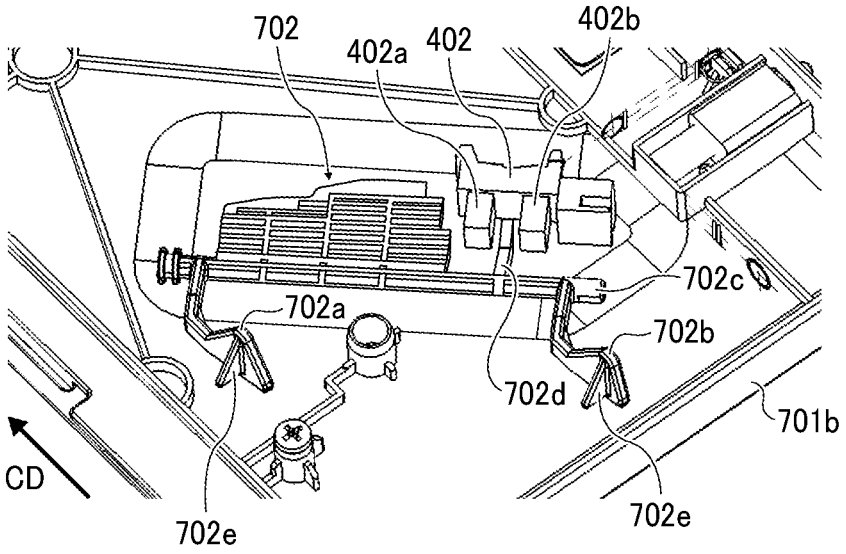
FIG. 12 is a diagram illustrating a sheet length detector according to an example of this disclosure.

FIG. 12 is a diagram illustrating the sheet length detector 702 according to this example.

The sheet length detector 702 includes the first sheet detecting part 702*a*, the second sheet detecting part 702*b*, and a rotary shaft 702*c*. Both the first sheet detecting part 702*a* and the second sheet detecting part 702*b* project upward from the loading face 710 on which the sheet P of the sheet loader cover 701*a* of the bypass tray body 701*b* jumps upward.

The first sheet detecting part 702*a* and the second sheet detecting part 702*b* stand on a peripheral surface of the rotary shaft 702*c* at both axial ends of the rotary shaft 702*c*.

By placing the sheet P on the bypass tray 701, either one of the first sheet detecting part 702*a* and the second sheet detecting part 702*b* is pressed by the sheet P to be stored into the bypass tray body 701*b* and, at the same time, the other of the first sheet detecting part 702*a* and the second sheet detecting part 702*b* is stored under the bypass tray body 701*b*.

A light blocking part 702*d* stands between the first sheet detecting part 702*a* and the second sheet detecting part 702*b* in the axial direction of the rotary shaft 702*c* on the peripheral surface of the bypass tray body 701*b* and close to the second sheet detecting part 702*b*.

As described above, the light blocking part 702*d* allows or blocks light transmission to the light receiving part 402*b* of the transmission optical sensor 402. According to movement of the light blocking part 702*d*, whether or not the length of the sheet P placed on the bypass tray 701 is a given length or greater is detected.

It is to be noted that a transmission optical sensor (e.g., the transmission optical sensor 402) can be replaced with a reflective optical sensor. For example, the reflective optical sensor can be applied to this disclosure to detect whether or not the length of the sheet P placed on the bypass tray 701 is a given length or greater based on presence or absence of the reflected light due to actions of the light blocking part 702*d*.

Further, both the first sheet detecting part 702*a* and the second sheet detecting part 702*b* have respective slant parts 702*e*. By providing the slant parts 702*e* to the first sheet detecting part 702*a* and the second sheet detecting part 702*b*, even when the sheet P is placed on the bypass tray body 701*b* either in a direction parallel to the sheet conveying direction or in a direction perpendicular to the sheet conveying direction, the sheet P can press down the first sheet detecting part 702*a* and the second sheet detecting part 702*b* with a less reaction force applied on the first sheet detecting part 702*a* and the second sheet detecting part 702*b*.

Figure 13A:
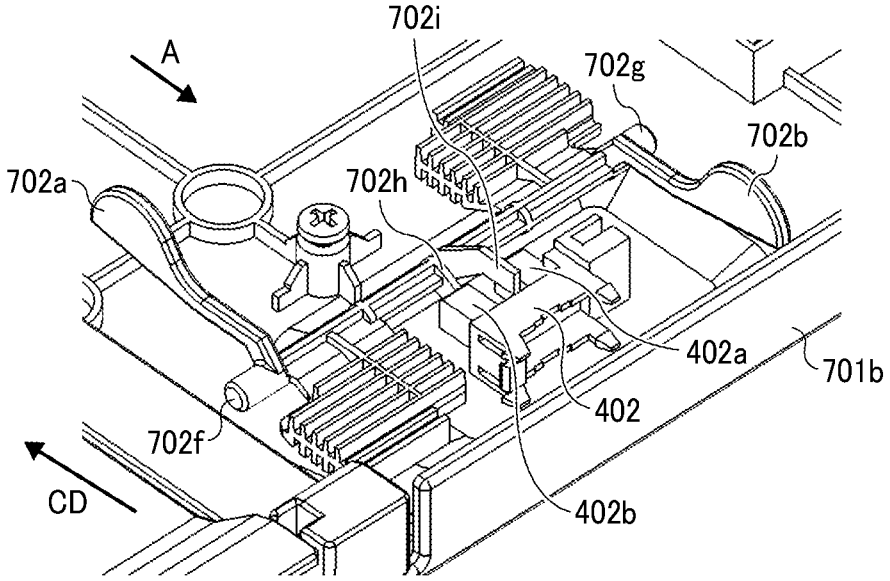
FIGS. 13A and 13B are diagrams illustrating a sheet length detector according to another example of this disclosure.
Figure 13B:
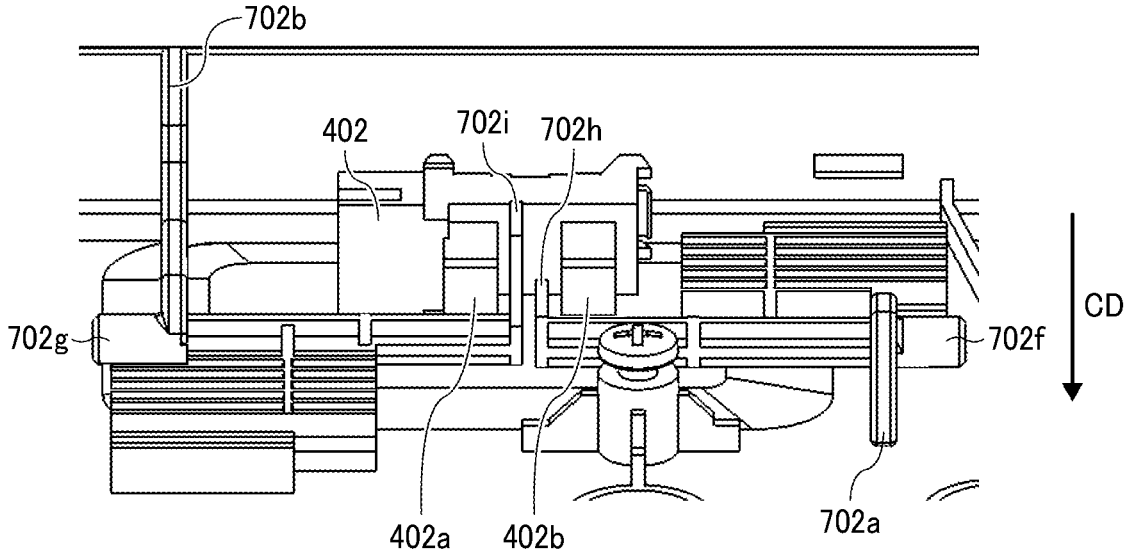

FIGS. 13A and 13B are diagrams illustrating the sheet length detector 702 according to another example of this disclosure.

As illustrated in FIGS. 13A and 13B, the sheet length detector 702 according to this example includes the first sheet detecting part 702*a* and the second sheet detecting part 702*b* to detect the sheet P placed on the bypass tray 701.

The first sheet detecting part 702*a* projects to be movable forward and backward from the loading face 710 of the bypass tray body 701*b* and the sheet loader cover 701*a* on which the sheet P is loaded. Further, the first sheet detecting part 702*a* stands on the peripheral surface of a first rotary shaft 702*f* at one axial end of the first rotary shaft 702*f*.

The second sheet detecting part 702*b* projects to be movable forward and backward from the loading face 710 of the sheet loader cover 701*a*. Further, the second sheet detecting part 702*b* stands on a peripheral surface of a second rotary shaft 702*g* of the loading face 710 at one axial end of the second rotary shaft 702*g*.

In addition, a first light blocking part 702*h* is disposed upright on the peripheral surface of the first rotary shaft 702*f* at the other axial end of the first rotary shaft 702*f*, which is an opposite axial end to the first sheet detecting part 702*a*. Further, a second light blocking part 702*i* is disposed upright on the peripheral surface of the second rotary shaft 702*g* at the other axial end of the second rotary shaft 702*g*, which is an opposite axial end to the second sheet detecting part 702*b*.

The first light blocking part 702*h* and the second light blocking part 702*i* stand at respective positions to perform blocking and transmitting the light from the transmission optical sensor 402 when a corresponding one of the first sheet detecting part 702*a* and the second sheet detecting part 702*b* is stored and rotated in the bypass tray body 701*b*.

At least one or both of the first light blocking part 702*h* and the second light blocking part 702*i* allow or block light transmission to the light receiving part 402*b* of the transmission optical sensor 402. According to movement of the first light blocking part 702*h* and the second light blocking part 702*i*, the transmission optical sensor 402 can detect whether or not the length of the sheet P placed on the bypass tray 701 is a given length or greater.

As described above, the sheet length detector 702 illustrated in FIGS. 13A and 13B has a configuration in which the first sheet detecting part 702*a* and the second sheet detecting part 702*b* individually perform blocking and transmitting the light with respect to the light receiving part 402*b* of the transmission optical sensor 402.

Figure 14:
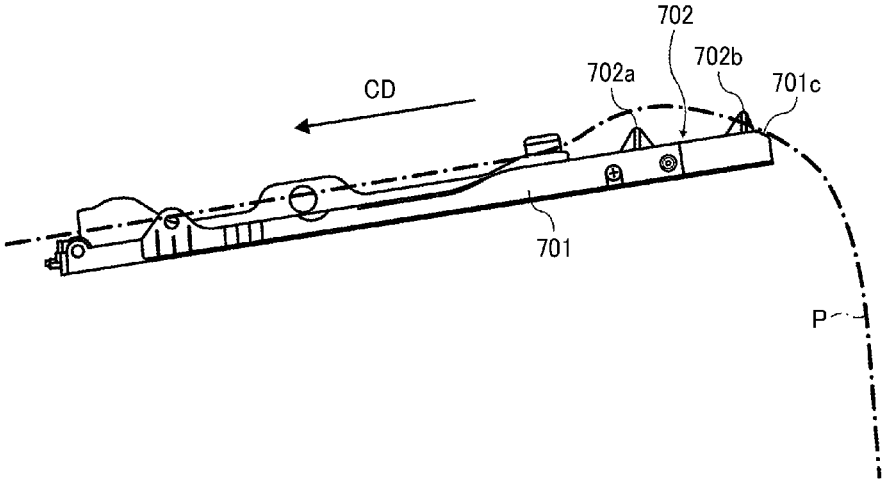
FIG. 14 is a side view illustrating a bypass tray when a large-size sheet is set without extending an extendable tray to a tray body of the bypass tray.

FIG. 14 is a side view illustrating the bypass tray 701 when a large-size sheet P is set on the bypass tray 701 without extending the extendable tray 703 from the bypass tray body 701*b*.

The sheet P at the first sheet detecting part 702*a* of FIG. 14 is lifted and held at the same position as the sheet P at the sheet detecting part 401*a* of FIG. 9. However, the sheet P at the second sheet detecting part 702*b* of FIG. 14 is less lifted and held at a lower position than the sheet P at the first sheet detecting part 702*a* of FIG. 14. According to this state, the second sheet detecting part 702*b* is pressed down by the sheet P.

It is to be noted that FIG. 14 illustrates a state of the first sheet detecting part 702*a* and the second sheet detecting part 702*b* with no sheet P loaded on the bypass tray 701. As indicated with a dot-dashed line in FIG. 14, when the sheet P is placed on the bypass tray 701, the second sheet detecting part 702*b* is pressed down under the bypass tray body 701*b* due to the weight of the sheet P. Along with this action, the first sheet detecting part 702*a* moves down to the inside of the bypass tray body 701*b*.

In addition, as illustrated in FIG. 14, the inclined surface 701*c* that is slanted to the loading face 710 is disposed at the upstream end of the bypass tray body 701*b* of the bypass tray 701 in the sheet conveying direction. By so doing, the sheet P is moved upward to a position lower than the sheet P of FIG. 6. By so doing, the sheet P is moved upward to a position lower than the sheet P of FIG. 6. Accordingly, the amount of projection of the second sheet detecting part 702*b* from the peripheral surface of the bypass tray body 701*b* can be reduced and, as a result, the thickness of the bypass tray body 701*b* of the bypass tray 701 can be reduced.

It is to be noted that, when the inclined surface 701*c* is disposed at the upstream end of the bypass tray body 701*b* of the bypass tray 701 in the sheet conveying direction, another inclined surface having the same slanted part as the inclined surface 701*c* is preferably provided at the upstream end of the extendable tray 703 in the sheet conveying direction. By so doing, the sheet P moves less upward at the center of the bypass tray 701 in the sheet width direction.

As described above, the bypass tray 701 in this example includes the extendable tray 703 that is extendable from the bypass tray body 701*b*. However, the configuration of the bypass tray 701 is not limited thereto. For example, this disclosure can be applied to a configuration in which the bypass tray 701 that does not include the extendable tray 703. Specifically, the above-described sheet length detector 702 is effectively provided to the bypass tray 701 that does not have the extendable tray 703 to correctly detect the sheet P having the size equal to or greater than the bypass tray 701 in the sheet conveying direction.

Figure 15:
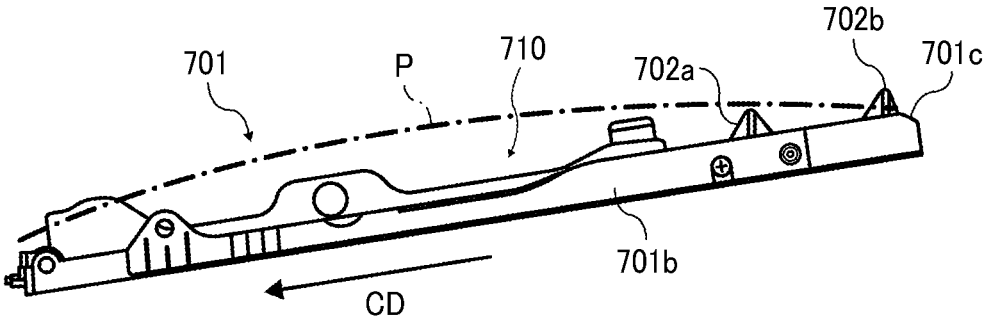
FIG. 15 is a side view illustrating the bypass tray when a curled sheet is loaded on the bypass tray.
Figure 16:
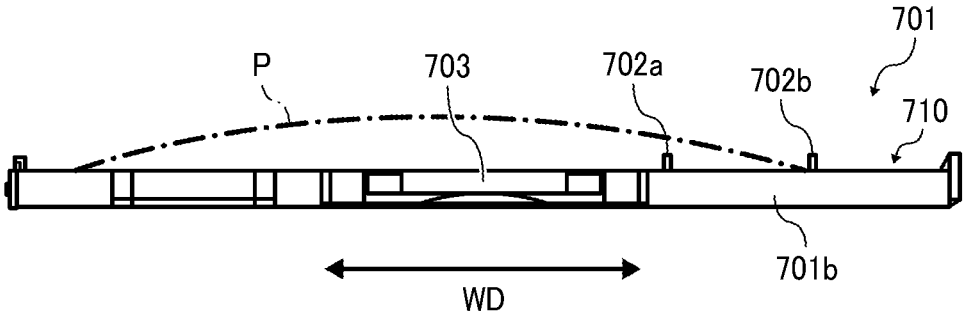
FIG. 16 is a diagram illustrating the bypass tray on which the curled sheet is loaded, viewed from an upstream side in a sheet conveying direction.

FIG. 15 is a side view illustrating the bypass tray 701 when a curled sheet P is loaded on the bypass tray 701. FIG. 16 is a diagram illustrating the bypass tray 701 viewed from the upstream side in the sheet conveying direction of the bypass tray 701 on which the curled sheet is loaded.

As illustrated in FIGS. 15 and 16, when a sheet P having a portion that is curled at the center thereof in the sheet conveying direction and the center thereof in the sheet width direction or having a waved portion, it is likely to fail to detect the sheet P at the first sheet detecting part 702*a*.

Therefore, the second sheet detecting part 702*b* is disposed upstream from the first sheet detecting part 702*a* in the sheet conveying direction of the bypass tray 701 and closer to one lateral end of the bypass tray 701 in the sheet width direction, which is the direction perpendicular to the sheet conveying direction.

By so doing, even when the sheet P that is curled or waved on the surface thereof is placed on the bypass tray 701, the second sheet detecting part 702*b* can detect the presence or absence of the sheet P.

Accordingly, the second sheet detecting part 702*b* can detect various types of the sheet P not only having the size equal to or greater than the bypass tray 701 in the sheet conveying direction but also having a curled or waved portion.

The bypass tray 701 according to this example includes the second sheet detecting part 702*b* at the upstream end of the bypass tray body 701*b* in the sheet conveying direction. However, the configuration of the bypass tray 701 according to this example is not limited thereto.

For example, the second sheet detecting part 702*b* can detect the above-described curled sheet P or a waved sheet P that is lifted at the first sheet detecting part 702*a* even when the second sheet detecting part 702*b* is located at a position other than the position at the upstream end of the bypass tray body 701*b* in the sheet conveying direction.

Further, in the example illustrated in FIGS. 1 through 16, the bypass tray 701 of the image forming apparatus 1 is applied to the sheet loader 700. However, the configuration of the sheet loader 700 is not limited thereto. For example, the original document loading table 53 provided to the ADF 51 of the image reading unit 50 that functions as the image reader can be applied to the sheet loader 700.

Next, a description is given of the image forming apparatus 1 according to another example of this disclosure, with reference to FIGS. 17 through 23.

It is to be noted that the basic configuration of the image forming apparatus 1 according to this example is substantially identical to the configuration of the image forming apparatus 1 according to the example illustrated in FIGS. 1 through 16, and therefore a detailed description of the configuration of the image forming apparatus 1 of this example is omitted.

A description is given of the sheet loader 700 according to this example, with reference to FIGS. 17 through 22.

The sheet loader 700 according to this example includes the bypass tray 701.

Figure 17:
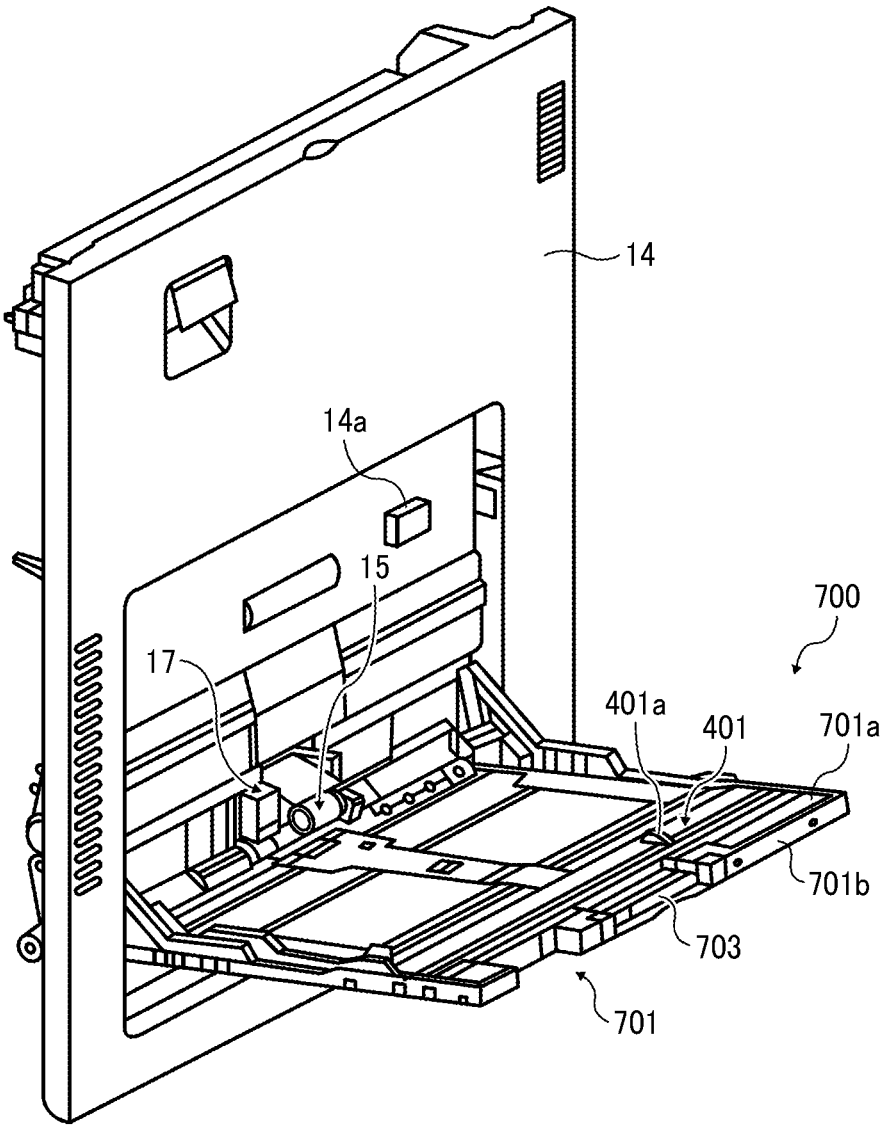
FIG. 17 is a perspective view illustrating a sheet loader according to an example of this disclosure.

It is to be noted that a basic configuration of the sheet loader 700 according to this example is substantially identical to the sheet loader 700 illustrated in FIGS. 1 through 16, and therefore a detailed description of the configuration of the sheet loader 700 illustrated in FIG. 17 is omitted. The bypass tray 701 used in the sheet loader 700 according to this example includes the sheet length detector 401 illustrated in FIG. 6.

Figure 18:
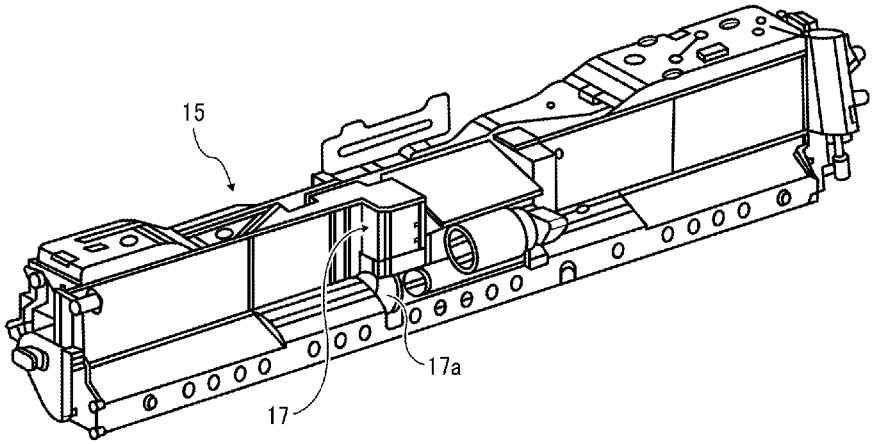
FIG. 18 is an enlarged perspective view illustrating a bypass sheet feeder providable to the sheet loader.

FIG. 18 is an enlarged perspective view illustrating the bypass sheet feeder 15 that is provided to the sheet loader 700.

As illustrated in FIG. 18, the bypass sheet feeder 15 includes a sheet existence detector 17 to detect presence or absence of the sheet P on the bypass tray 701. In other words, the sheet existence detector 17 detects whether or not the sheet P is loaded on the bypass tray 701.

Figure 19:
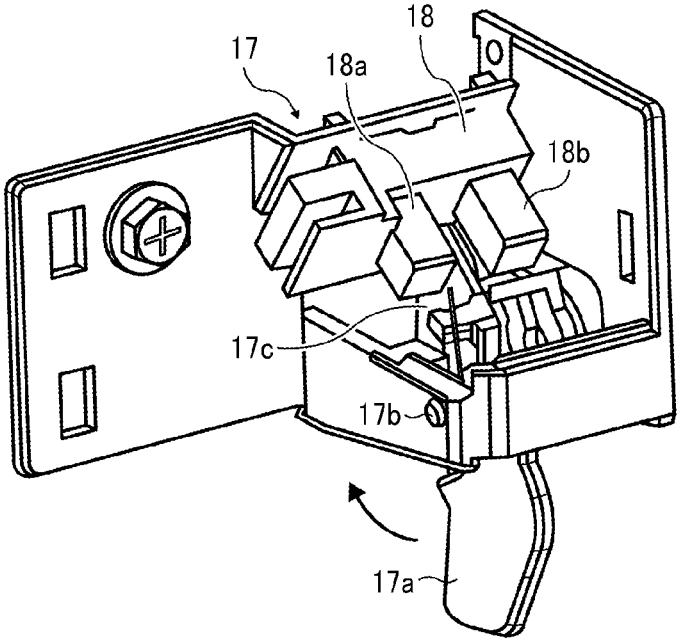
FIG. 19 is a perspective view illustrating a sheet existence detector.

FIG. 19 is a perspective view illustrating a schematic configuration of the sheet existence detector 17.

The sheet existence detector 17 includes a sheet contacting part 17*a*, a rotary shaft 17*b*, and a light blocking part 17*c*. The rotary shaft 17*b* is rotatably supported by a side panel of the sheet existence detector 17. The sheet contacting part 17*a* is disposed at one end in an axial direction of the rotary shaft 17*b*. The light blocking part 17*c* is disposed at a center or a substantially center in the axial direction of the rotary shaft 17*b*. The sheet existence detector 17 further includes a transmission optical sensor 18 that includes a light emitting part 18*a* and a light receiving part 18*b*. The transmission optical sensor 18 functions as a projection retreating detector. The light emitting part 18*a* and the light receiving part 18*b* are disposed with the light blocking part 17*c* located therebetween.

The sheet contacting part 17*a* is disposed to project downward to a conveying path of the bypass sheet feeder 15. When the sheet P is loaded on the bypass tray 701, the sheet contacting part 17*a* is pressed by the leading end of the sheet P. Accordingly, the sheet contacting part 17*a* rotates about the rotary shaft 17*b* in a direction indicated by arrow in FIG. 19.

Along with the movement of the sheet contacting part 17*a*, the light blocking part 17*c* is rotated about the rotary shaft 17*b* in the direction indicated by arrow in FIG. 19. By so doing, the light to the light receiving part 18*b* of the transmission optical sensor 18 is blocked or transmitted. As a result, the presence or absence of the sheet P is detected.

It is to be noted that a transmission optical sensor (e.g., the transmission optical sensor 18) can be replaced with a reflective optical sensor. For example, the reflective optical sensor can be applied to this disclosure to detect whether or not the sheet P exists on the bypass tray 701 based on presence or absence of the reflected light from the light blocking part 17*c*.

Figure 20:
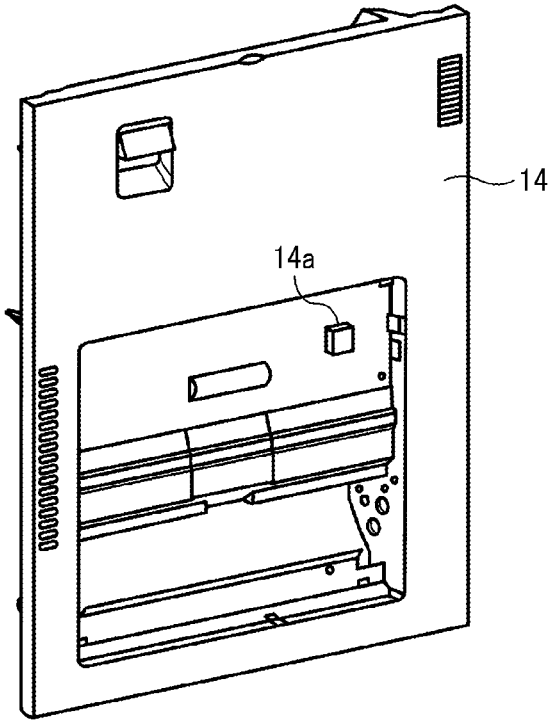
FIG. 20 is a perspective view illustrating a cover.

FIG. 20 is a perspective view illustrating the cover 14.

As illustrated in FIG. 20, the cover 14 includes a pressing part 14*a*. The pressing part 14*a* is a projection to press the sheet detecting part 401*a* to a position facing the sheet detecting part 401*a* of the sheet length detector 401 provided to the bypass tray 701 when the bypass tray 701 is closed with respect to the cover 14.

Figure 21:
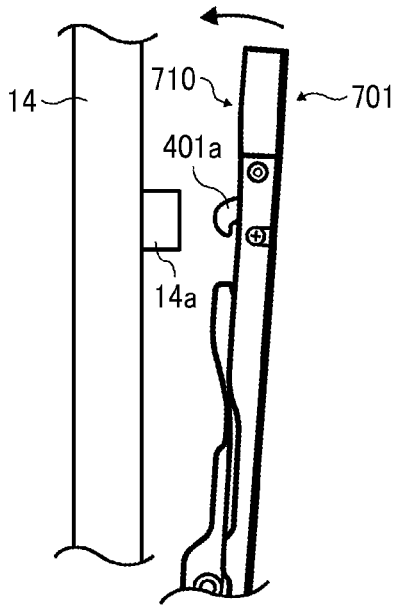
FIG. 21 is a diagram illustrating a state immediately before the bypass tray is closed to the cover.

FIG. 21 is a diagram illustrating a state immediately before the bypass tray 701 is closed to the cover 14.

In this state, since the sheet detecting part 401*a* of the sheet length detector 401 is not pressed toward the inside of the bypass tray 701, the sheet length detector 401 has detected that the length of the sheet P in the sheet conveying direction is less than the given length.

Further, no sheet P is loaded on the bypass tray 701 at this time, and therefore the sheet existence detector 17 has detected absence of the sheet P.

Figure 22:
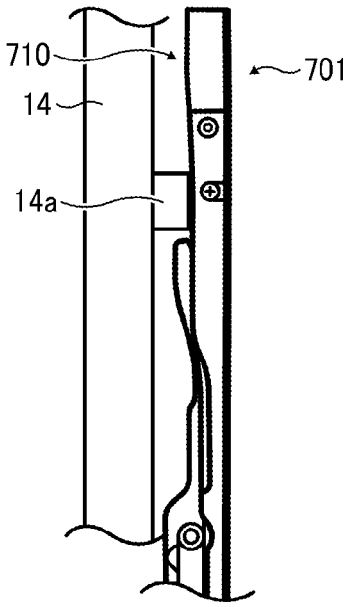
FIG. 22 is a diagram illustrating a state in which the bypass tray is closed to the cover.

FIG. 22 is a diagram illustrating a state in which the bypass tray 701 is closed to the cover 14.

In this state, the sheet detecting part 401*a* of the sheet length detector 401 is pressed by the pressing part 14*a* of the cover 14 toward the inside of the bypass tray 701, and therefore the sheet length detector 401 has detected that the sheet P in the sheet conveying direction has the given length or greater.

Further, no sheet P is loaded on the bypass tray 701 at this time, and therefore the sheet existence detector 17 has detected absence of the sheet P.

Table 1 shows opening and closing states of the bypass tray 701 to the cover 14 determined based on a combination of detection results obtained by the sheet existence detector 17 and detection results obtained by the sheet length detector 401.

TABLE 1

| Sheet Existence | Detected Results | | | |
|---|---|---|---|---|
| Detector | Presence | Presence | Absence | Absence |
| Sheet Length Detector | Equal to or greater than a given length | Less than a given length | Equal to or greater than a given length | Less than a given length |
| State of Bypass Tray | Open | Open | Close | Open |

When the detection result obtained by the sheet existence detector 17 is "Absence" and the detection result obtained by the sheet length detector 401 is "Less than a given length", the controller 400 detects and determines that the bypass tray 701 is open.

Further, when the detection result obtained by the sheet existence detector 17 is "Absence" and the detection result obtained by the sheet length detector 401 is "Equal to or greater than a given length", the controller 400 detects and determines that the bypass tray 701 is closed.

Figure 23:
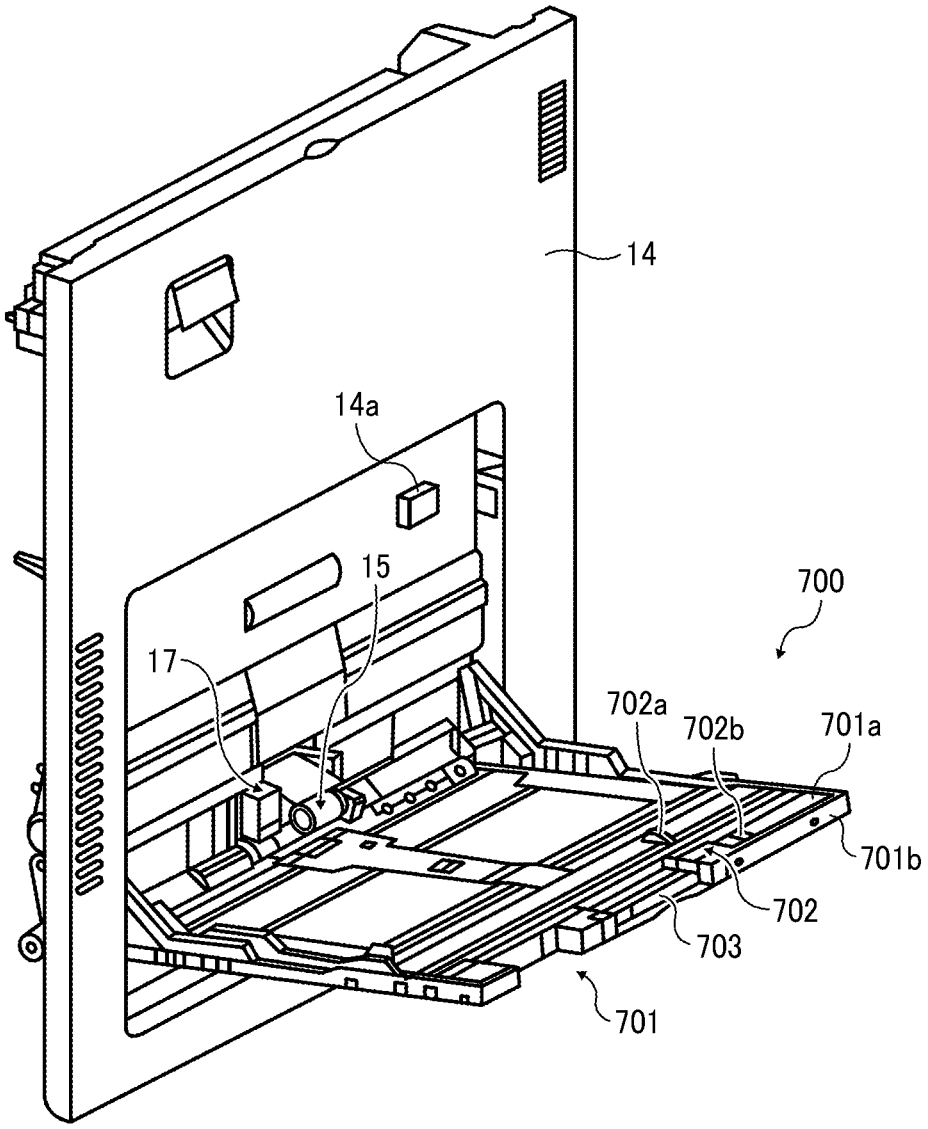
FIG. 23 is a perspective view illustrating the sheet loader provided to the image forming apparatus according to an example of this disclosure.

A description is given of a configuration of the sheet loader 700 according to another example of this disclosure, with reference to FIG. 23.

FIG. 23 is a perspective view illustrating the sheet loader 700 provided to the image forming apparatus 1 according to this example.

It is to be noted that a basic configuration of the sheet loader 700 according to this example is substantially identical to the sheet loader 700 illustrated in FIGS. 1 through 16, and therefore a detailed description of the configuration of the sheet loader 700 illustrated in FIG. 23 is omitted.

In this example, the sheet length detector 702 described with FIG. 12 is employed as a sheet length detector provided to the bypass tray 701, which is different from the sheet loader 700 illustrated in FIGS. 17 through 22.

It is to be noted that a configuration of the sheet length detector 702 provided to the bypass tray 701 in this example is basically identical to the sheet length detector 702 described with FIG. 12. Therefore, a detailed description of the configuration of the sheet length detector 702 is omitted.

As illustrated in FIG. 23, the cover 14 includes the pressing part 14*a*. The pressing part 14*a* is a projection to press the first sheet detecting part 702*a* to a position facing the first sheet detecting part 702*a* of the sheet length detector 702 provided to the bypass tray 701 when the bypass tray 701 is closed with respect to the cover 14.

In the state in which the bypass tray 701 is closed to the cover 14, the first sheet detecting part 702*a* is pressed under and inside of the bypass tray 701 by the pressing part 14*a*.

Pressing the sheet detecting part 702*a* under the bypass tray 701 rotates the rotary shaft 702*c*. Along with the rotation of the rotary shaft 702*c*, the light blocking part 702*d* rotates to block or transmit light from the light receiving part 402*b* of the transmission optical sensor 402. As a result, the sheet length detector 702 detects that the sheet P has a given length or greater.

Further, no sheet P is loaded on the bypass tray 701 when the bypass tray 701 is closed to the cover 14, and therefore the sheet existence detector 17 has detected absence of the sheet P.

By contrast, in the state immediately before the bypass tray 701 is closed to the cover 14, the first sheet detecting part 702*a* is not pressed toward the inside of the bypass tray 701. Therefore, the sheet length detector 702 has detected that the length of the sheet P in the sheet conveying direction is less than the given length.

Further, no sheet P is loaded on the bypass tray 701 when the bypass tray 701 is about to close to be closed to the cover 14, and therefore the sheet existence detector 17 has detected absence of the sheet P.

Consequently, as described above, when the detection result obtained by the sheet existence detector 17 is "Absence" and the detection result obtained by the sheet length detector 702 is "Equal to or greater than a given length", the controller 400 detects and determines that the bypass tray 701 is closed.

By contrast, when the detection result obtained by the sheet existence detector 17 is "Absence" and the detection result obtained by the sheet length detector 702 is "Less than a given length", the controller 400 detects and determines that the bypass tray 701 is open.

Accordingly, the above-described configuration of the sheet loader 700 does not include a dedicated sensor to detect the opening and closing states of the bypass tray 701 with respect to the cover 14. As a result, the sheet loader 700, the image forming apparatus 1, or both can be reduced in size and cost.

Further, in the image forming apparatus 1 according to this disclosure, when the controller 400 detects that the bypass tray 701 is open to the cover 14, the opening of the bypass tray 701 is displayed on a display provided to the control panel 13 to indicate how to feed the sheet P via the bypass tray 701. This operation can simplify a setting of various types and sizes of sheets to be fed from the bypass tray 701 when an operator feed the sheet P from the bypass tray 701.

Further, since it takes time to start the image forming apparatus 1, when the opening of the bypass tray 701 to the cover 14 is detected, a state of the image forming part 100 is changed to an image forming preparation state. By so doing, the operator can reduce time to wait until the image forming apparatus 1 becomes ready.

In this example, the state of detection of the sheet length detector 702 is changed based on whether or not the first sheet detecting part 702*a* is pressed by the projected pressing part 14*a* provided to the cover 14. However, the operation of detection by the sheet length detector 702 is not limited thereto.

For example, a configuration without the pressing part 14*a* on the cover 14 can achieve the same effect as the above-described configuration. In this case, an optimized weight balance to switch between a light blocking state and a light transmitting state may be employed during the state in which the bypass tray 701 is closed to the cover 14.

Further, when the sheet length detector 702 is a reflective optical sensor, the state of detection of the sheet length detector 702 can be switched by detecting light reflected by the pressing part 14*a*.

The configurations according to the above-described embodiment are examples. The present invention can achieve the following aspects effectively.

[Aspect A]

In Aspect A, a sheet loader (for example, the sheet loaders 700, 500) includes a sheet length detector (e.g., the bypass tray 701 and the original document loading table 53) and a sheet length detector (e.g., the sheet length detector 702, the sheet length detector 401). The sheet loader has a loading face (e.g., the loading face 710, 53*a*) on which a sheet (e.g., the sheet P) is loaded. The sheet length detector is provided to the sheet loading part and detects a length of the sheet by obtaining information whether the loading face either contacts or approaches a surface of the sheet disposed facing the loading face at a given position on the loading face in a sheet conveying direction of the loading part. The sheet length detector includes multiple projections (e.g., the first sheet detecting part 702*a* and the second sheet detecting part 702*b*) and a projection retreating detector (e.g., the transmission optical sensor 402, 18). Each of the multiple projections retreatably extends outward beyond the loading face of the sheet loading part. The projection retreating detector detects whether the multiple projections are retreated under the loading face. In the sheet loader, at least one of the multiple projections (702*b*) is disposed at a position closer to an upstream end of the sheet loading part in the sheet conveying direction than the other (702*a*) of the multiple projections (702*a*, 702*b*).

In Aspect A, since the amount of rise of lift of the sheet is small in the vicinity of the upstream end of the sheet loading part in the sheet conveying direction, the multiple projections of the sheet length detector are added in this area. Accordingly, the sheet length detector having one projection retreating detector can properly detect the sheet having a size equal to or greater than the sheet loading part in the sheet conveying direction. As a result, compared with a configuration having multiple projection retreating detector, this configuration can reduce the cost and detect the length of the sheet loaded on the sheet loading part properly.

[Aspect B]

In Aspect A, the at least one of the multiple projections is disposed at a position more distant from the other of the multiple projections in a direction perpendicular to the sheet conveying direction on the sheet loading part. Accordingly, as described in the examples above, even when the curled sheet is placed on the sheet loading part, the length of the sheet can be detected.

[Aspect C]

In Aspect A or B, the sheet loader further includes an extendable loading part (e.g., the extendable tray 703) to extend from the upstream end of the sheet loading part in the sheet conveying direction and switch a state of the sheet loading part between an extended state in which the extendable loading part holds a trailing end of the sheet extending outside the loading face toward an upstream side of the sheet loading part in the sheet conveying direction and a non-extended state in which the extendable loading part does not hold the trailing end of the sheet extending outside the loading face. When the extendable loading part is in the non-extended state, the at least one of the multiple projections is located at a position capable of detecting the sheet extending from the loading face of the sheet loading part toward the upstream side in the sheet conveying direction.

Accordingly, as described in the examples above, even if the extendable loading part is in the non-extended state, the length of the sheet that extends outside from the loading face of the sheet loading part toward to the upstream side in the sheet conveying direction can be detected.

[Aspect D]

In any one of Aspects A through C, the sheet loader further includes an inclined surface (e.g., the inclined surface 701*c*) that is slanted to the loading face at a part where any one of the multiple projections extends from the loading face of the sheet loading part.

Accordingly, as described in the examples above, the sheet can press down the any one of the multiple projections with a less reaction force applied to the any one of the multiple projections.

[Aspect E]

In any one of Aspects A through D, the sheet loader further includes an inclined surface (e.g., the inclined surface 701*c*) that is slanted to the loading face at the upstream end of the sheet loading part in the sheet conveying direction.

Accordingly, as described in the examples above, the amount of projection from the loading face of the sheet loading part can be reduced and, as a result, the thickness of the sheet loading part can be reduced.

[Aspect F]

In any one of Aspects A through E, the sheet loader further includes an inclined surface (e.g., the inclined surface 701*c*) that is slanted to the loading face at the upstream end of the sheet loading part in the sheet conveying direction when the extendable loading part is at least in a non-extended state.

Accordingly, as described in the examples above, the rise or lift of the sheet off from the sheet loading part can be reduced or prevented.

[Aspect G]

In any one of Aspects A through F, the sheet loader further includes a sheet width detector (e.g., the rotary switch 705) and a sheet size discriminator (e.g., the sheet size discriminator 800). The sheet width detector detects a width of the sheet loaded on the loading face of the sheet loading part in a width direction perpendicular to the sheet conveying direction. The sheet size discriminator discriminates whether the sheet loaded on the loading face of the sheet loading part has a size of given multiple types of sheets based on detection results obtained by the sheet length detector and detection results of the sheet width detector.

Accordingly, as described in the examples above, the size of the sheet can be specified properly based on two types of the detection results obtained by the sheet length detector and the sheet width detector.

[Aspect H]

In any one of Aspects A through G, the sheet length detector can include a reflective optical sensor.

[Aspect I]

In an image forming apparatus that includes a sheet loader to load a sheet thereon and an image forming part to form and transfer an image onto the sheet fed from the sheet loader, the sheet loader according to any one of Aspects A through H is employed.

Accordingly, as described in the examples above, a sheet length detector having at least one sensor can correctly detect the length of the sheet placed on the sheet loader.

[Aspect J]

In an image reader that includes a sheet loader to load a sheet thereon and an image reading member to receive and read an image formed on the sheet loaded on the sheet loader, the sheet loader according to any one of Aspects A through H can be employed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet loader comprising:

a sheet loading part having a loading face on which a sheet is loaded; and a sheet length detector provided to the sheet loading part to detect a length of the sheet by obtaining information whether the loading face either contacts or approaches a surface of the sheet disposed facing the loading face at a given position on the loading face in a sheet conveying direction of the sheet loading part, the sheet length detector comprising a common rotatable shaft;

multiple projections, mounted on the common rotatable shaft, each of which retreatably extends above the loading face of the sheet loading part; and a single projection retreating detector extending from the common rotatable shaft and having only a single light blocking part, the single projection retreating detector being configured to detect whether each of the multiple projections are retreated beneath the loading face, wherein at least one of the multiple projections is disposed at an upstream end of the sheet loading part in the sheet conveying direction.

2. The sheet loader according to claim 1, wherein the at least one of the multiple projections is disposed outside from the other of the multiple projections in a direction perpendicular to the sheet conveying direction on the sheet loading part.

3. The sheet loader according to claim 2, further comprising an extendable loading part to extend from the upstream end of the sheet loading part in the sheet conveying direction and to switch a state of the sheet loading part between an extended state in which the extendable loading part holds a trailing end of the sheet extending outside the loading face toward an upstream side of the sheet loading part in the sheet conveying direction and a non-extended state in which the extendable loading part does not hold the trailing end of the sheet extending outside the loading face, wherein, when the extendable loading part is in the non-extended state, the at least one of the multiple projections is located at a position capable of detecting the sheet extending from the loading face of the sheet loading part toward the upstream side in the sheet conveying direction.

4. The sheet loader according to claim 3, wherein the extendable loading part has an inclined surface that is slanted to the loading face at a part where any one of the multiple projections extends from the loading face of the sheet loading part.

5. The sheet loader according to claim 3, further comprising an inclined surface that is slanted to the loading face at an upstream end of the extendable loading part in the sheet conveying direction.

6. The sheet loader according to claim 3, further comprising an inclined surface that is slanted to the loading face at the upstream end of the extendable loading part in the sheet conveying direction when the extendable loading part is at least in a non-extended state.

7. The sheet loader according to claim 3, further comprising:

a sheet width detector to detect a width of the sheet loaded on the loading face of the sheet loading part in a width direction perpendicular to the sheet conveying direction; and a sheet size discriminator to discriminate whether the sheet loaded on the loading face of the sheet loading part has a size of given multiple types of sheets based on detection results obtained by the sheet length detector and detection results of the sheet width detector.

8. The sheet loader according to claim 2, further comprising an inclined surface that is slanted to the loading face at a part where any one of the multiple projections extends from the loading face of the sheet loading part.

9. The sheet loader according to claim 2, further comprising an inclined surface that is slanted to the loading face at the upstream end of the sheet loading part in the sheet conveying direction when an extendable loading part is at least in a non-extended state.

10. The sheet loader according to claim 2, further comprising:

a sheet width detector to detect a width of the sheet loaded on the loading face of the sheet loading part in a width direction perpendicular to the sheet conveying direction; and a sheet size discriminator to discriminate whether the sheet loaded on the loading face of the sheet loading part has a size of given multiple types of sheets based on detection results obtained by the sheet length detector and detection results of the sheet width detector.

11. The sheet loader according to claim 2, wherein the sheet length detector includes a reflective optical sensor.

12. The sheet loader according to claim 1, further comprising an extendable loading part to extend from the upstream end of the sheet loading part in the sheet conveying direction and to switch a state of the sheet loading part between an extended state in which the extendable loading part holds a trailing end of the sheet extending outside the loading face toward an upstream side of the sheet loading part in the sheet conveying direction and a non-extended state in which the extendable loading part does not hold the trailing end of the sheet extending outside the loading face, wherein, when the extendable loading part is in the non-extended state, the at least one of the multiple projections is located at a position capable of detecting the sheet extending from the loading face of the sheet loading part toward the upstream side in the sheet conveying direction.

13. The sheet loader according to claim 1, further comprising an inclined surface that is slanted to the loading face at a part where any one of the multiple projections extends from the loading face of the sheet loading part.

14. The sheet loader according to claim 1, further comprising an inclined surface that is slanted to the loading face at the upstream end of the sheet loading part in the sheet conveying direction.

15. The sheet loader according to claim 1, further comprising an inclined surface that is slanted to the loading face at the upstream end of the sheet loading part in the sheet conveying direction when an extendable loading part is at least in a non-extended state.

16. The sheet loader according to claim 1, further comprising:

a sheet width detector to detect a width of the sheet loaded on the loading face of the sheet loading part in a width direction perpendicular to the sheet conveying direction; and a sheet size discriminator to discriminate whether the sheet loaded on the loading face of the sheet loading part has a size of given multiple types of sheets based on detection results obtained by the sheet length detector and detection results of the sheet width detector.

17. The sheet loader according to claim 1, wherein the sheet length detector includes a reflective optical sensor.

18. An image forming apparatus comprising:

the sheet loader according to claim 1; and an image forming part to form and transfer an image onto the sheet fed from the sheet loader.

19. An image reader comprising:

the sheet loader according to claim 1; and an image reading member to receive and read an image formed on the sheet loaded on the sheet loader.

20. The sheet loader according to claim 1, wherein the multiple projections include at least three slant parts that form an apex of the respective projection.

* * * * *